US008591199B2

(12) United States Patent
Martinez et al.

(10) Patent No.: US 8,591,199 B2
(45) Date of Patent: Nov. 26, 2013

(54) MULTI-STAGE COMPRESSOR/DRIVER SYSTEM AND METHOD OF OPERATION

(75) Inventors: Bobby D. Martinez, Sugar Land, TX (US); John R. Wolflick, Las Cruces, NM (US); Jaleel Valappil, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 1567 days.

(21) Appl. No.: 11/622,338

(22) Filed: Jan. 11, 2007

(65) Prior Publication Data

US 2008/0170948 A1 Jul. 17, 2008

(51) Int. Cl.
*F04B 23/04* (2006.01)

(52) U.S. Cl.
USPC ..... 417/199.2; 417/244; 417/246; 417/247; 417/286; 417/53

(58) Field of Classification Search
USPC ..... 417/53, 62, 199.1, 199.2, 244, 246, 417/247, 248, 250, 251, 252, 253, 286, 287, 417/288, 423.5; 60/39.183, 39.465; 62/228.5
See application file for complete search history.

(56) References Cited

U.S. PATENT DOCUMENTS

| | | | | |
|---|---|---|---|---|
| 3,503,206 | A * | 3/1970 | Strub | 60/646 |
| 3,579,982 | A * | 5/1971 | Strub | 60/667 |
| 4,172,711 | A | 10/1979 | Bailey | |
| 4,445,917 | A | 5/1984 | Chiu | |
| 5,651,270 | A | 7/1997 | Low et al. | |
| 5,669,234 | A | 9/1997 | Houser et al. | |
| 5,689,141 | A | 11/1997 | Kikkawa et al. | |
| 6,164,901 | A * | 12/2000 | Blotenberg | 415/1 |
| 6,289,692 | B1 | 9/2001 | Houser et al. | |
| 6,463,740 | B1 | 10/2002 | Schmidt et al. | |
| 6,640,586 | B1 | 11/2003 | Baudat et al. | |
| 6,691,531 | B1 | 2/2004 | Martinez et al. | |
| 6,755,620 | B2 * | 6/2004 | Nakamura et al. | 417/2 |
| 6,779,333 | B2 | 8/2004 | Gerhold | |
| 6,925,837 | B2 | 8/2005 | Eaton | |
| 2005/0022552 | A1 | 2/2005 | Lucas et al. | |

FOREIGN PATENT DOCUMENTS

| | | |
|---|---|---|
| WO | WO 97/33131 | 9/1997 |
| WO | WO 2005/010375 | 2/2005 |

OTHER PUBLICATIONS

Elena Lencioni and Alessio Mariani, Gas Turbines in LNG World, LNG Journal, Jan./Feb. 2005, p. 45, Stuart Fryer—Publisher, London, UK.

Gas Processors Suppliers Association, Section 15—Prime Movers for Mechanical Drives, Gas Processors Suppliers Association Engineering Data Book, 12th Edition (Electronic), Section 15, 2004, pp. 15-1 through 15-28, vols. I & II, Gas Processors Suppliers Association—Publisher, Tulsa, OK.

* cited by examiner

*Primary Examiner* — Charles Freay
*Assistant Examiner* — Christopher Bobish
(74) *Attorney, Agent, or Firm* — ConocoPhillips Company

(57) ABSTRACT

An improved system and methodology for starting up a gas-turbine driven multi-stage compressor. The improvement involves isolating individual compression stages and creating positive pressure in each stage prior to initiating rotation of the compressor/driver system. The isolation of individual compression stages allows the turbine to reach normal operating speeds with substantially no supplemental power from an auxiliary source.

22 Claims, 2 Drawing Sheets

MULTI-STAGE COMPRESSOR/DRIVER SYSTEM AND METHOD OF OPERATION

BACKGROUND OF THE INVENTION

1. Field of the Invention

The present invention generally relates to turbine-driven multi-stage compressors. In another aspect, the invention concerns an improved methodology for starting up a multi-stage compressor driven by a single-shaft gas turbine.

2. Description of the Prior Art

Gas turbines are commonly used to drive large, industrial compressors, such as those employed in the refrigeration cycles of liquefied natural gas (LNG) facilities. Gas turbines used to drive large compressors generally have a single-shaft or a split-shaft configuration. Compressor systems driven by split-shaft gas turbines are typically easier to start-up, but single-shaft gas turbines are available in higher power ratings. Generally, split-shaft gas turbines either are not commercially available or are not economically viable for use in very high load applications, such as for driving the multi-stage compressors of an LNG facility. Therefore, single-shaft gas turbines are usually selected to drive very large multi-stage compressors in industrial applications.

One disadvantage associated with employing a single-shaft gas turbine to drive a large, multi-stage compressor is the requirement for auxiliary power to help start-up the compressor/turbine system. In the past, such auxiliary start-up power has typically been provided by electric motors. These auxiliary motors run at or near full capacity during start-up to help overcome the inertial and aerodynamic forces of the system. After start-up, the auxiliary motor is shut off or scaled back, as the gas turbine takes over primary responsibility for powering the system. Obviously, the requirement for an auxiliary source of rotational power during start-up adds to the overall capital expense of the system.

Another disadvantage of using a single-shaft gas turbine to drive a large, multi-stage compressor is the potential for creating a vacuum in the system upon start-up, which creates a mechanism for air ingress into the system. While manageable, air-contamination of the working fluid is highly undesirable and can present additional operational and/or safety problems.

Thus, a need exists for an improved system and methodology to efficiently start-up large, industrial multi-stage compressors.

SUMMARY OF THE INVENTION

In one embodiment of the present invention, there is provided a method of operating a multi-stage compressor. The method comprises: (a) isolating at least two compression stages of the multi-stage compressor from fluid flow communication with one another; and (b) simultaneously with step (a), initiating rotation of the multi-stage compressor.

In another embodiment of the present invention, there is provided a system for operating a multi-stage compressor having a plurality of compression stages with each compression stage having an inlet and an outlet. The system comprises a driver for rotating the multi-stage compressor, a plurality of flow loops, and an isolation valve fluidly disposed between two of the flow loops. Each of the flow loops is associated with a compression stage and is configured to provide fluid flow communication from the outlet to the inlet of the compression stage with which it is associated. The system is shiftable between a start-up mode and an operating mode. During the start-up mode, the isolation valve is closed to thereby prevent fluid flow between two of the flow loops. During the normal mode of operation, the isolation valve is open to thereby permit fluid flow between two of the flow loops.

BRIEF DESCRIPTION OF THE FIGURES

Certain embodiments of the present invention are described in detail below with reference to the enclosed figures, wherein.

DETAILED DESCRIPTION

Figure 1:
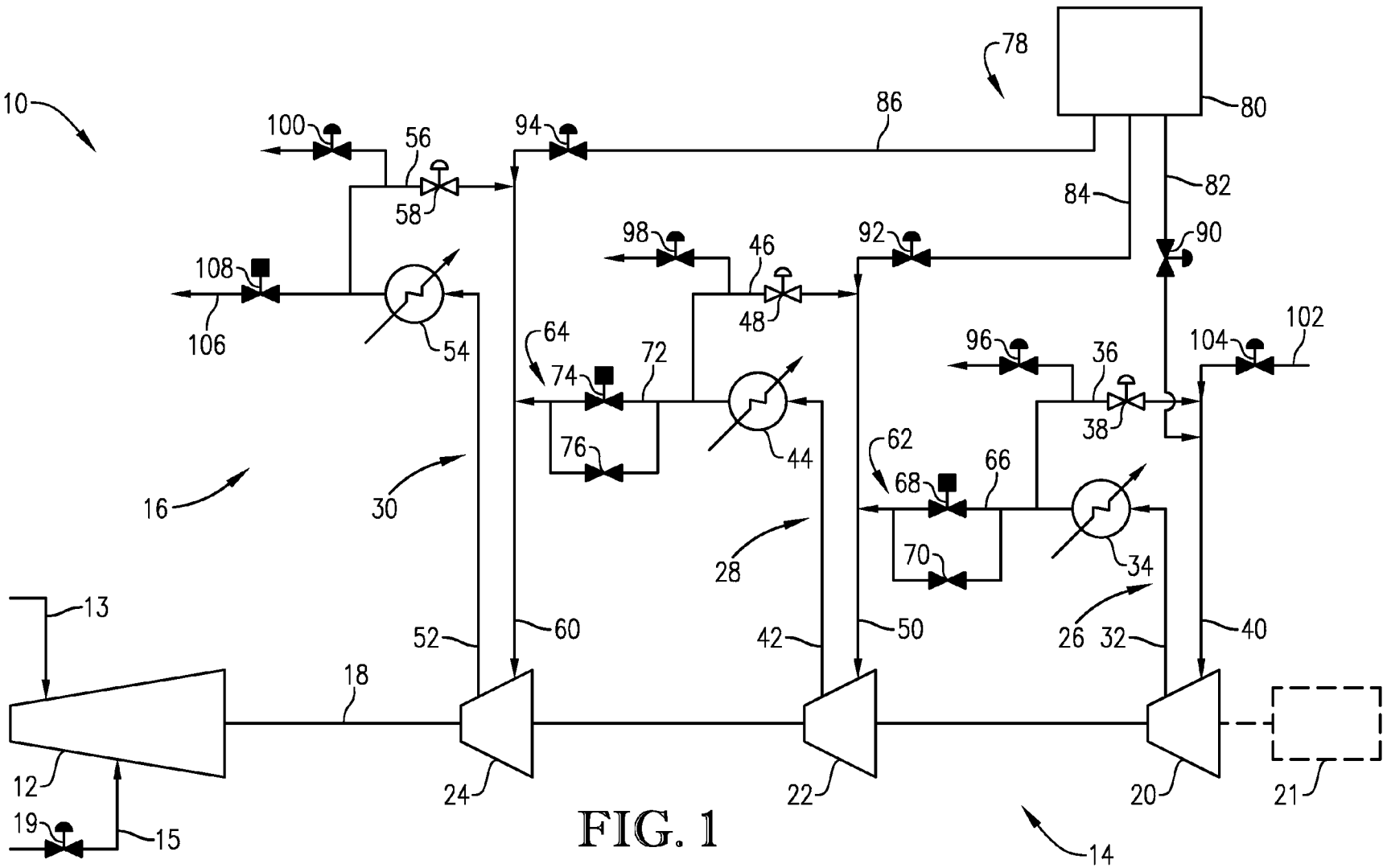
FIG. 1 is a schematic view of a compressor/driver system that includes a three-stage compressor driven by a single-shaft gas turbine.

Referring initially to FIG. 1, a simplified compressor/driver system 10 is illustrated as generally comprising a gas turbine 12, a multi-stage compressor 14, and a compressor flow control system 16. In general, gas turbine 12 powers multi-stage compressor 14, while flow control system 16 directs the flow of gas through the stages of multi-stage compressor 14.

Gas turbine 12 can be any suitable commercially available industrial gas turbine. In one embodiment, gas turbine 12 is a single-shaft gas turbine having a power rating greater than about 35,000 hp, greater than about 45,000 hp, or greater than 55,000 hp. For example, gas turbine 12 can be a single-shaft GE Frame-5, Frame-6, Frame-7, or Frame-9 gas turbine available from GE Power Systems, Atlanta, Ga. or the equivalent thereof. Gas turbine 12 receives a stream of filtered air from conduit 13 and fuel via conduit 15 as controlled by valve 19. The combustion of the air and fuel provides energy to rotate gas turbine 12. According to one embodiment, gas turbine 12 additionally comprises a built-in starting device (not shown) coupled to the air compressor side (i.e., the "cold end") of gas turbine 12.

Gas turbine 12 is operably coupled to multi-stage compressor 14 by a single common output drive shaft 18. Multi-stage compressor 14 comprises a plurality of compression stages operable to sequentially compress a gas stream to successively higher pressures. Compressor 14 of FIG. 1 is illustrated as having three compression stages: a low compression stage 20, an intermediate compression stage 22, and a high compression stage 24. Multi-stage compressor 14 can be a centrifugal compressor, an axial compressor, or any combination thereof. In the embodiment shown in FIG. 1, compressor 14 is a three-stage centrifugal compressor.

As previously mentioned, the compressor/driver system 10 includes compressor flow control system 16 that is operable to direct the flow of gas associated with multi-stage compressor 14. As illustrated in FIG. 1, flow control system 16 includes a plurality of flow loops 26, 28, 30, each associated with a respective compressor stage 20, 22, 24 of multi-stage compressor 14. Each flow loop is operable to provide a path of fluid flow from the outlet of its associated compression stage to the inlet of the same compression stage. For example, low-stage flow loop 26 is operable to route compressed gas from the discharge of low compression stage 20 to its suction via discharge conduit 32, intercooler 34, recycle conduit 36, anti-surge valve 38, and suction conduit 40. Intermediate-stage flow loop 28 is operable to route compressed gas from the discharge of intermediate compression stage 22 to its suction via discharge conduit 42, intercooler 44, recycle conduit 46, anti-surge valve 48, and suction conduit 50. High-stage flow loop 30 is operable to route compressed gas from the discharge to the suction of high compression stage 24 via discharge conduit 52, intercooler 54, recycle conduit 56, anti-surge valve 58, and suction conduit 60.

Compressor/driver system 10 of the present invention can be operated in two distinct modes: a start-up mode and a normal mode. During the normal mode of operation, flow loops 26, 28, 30 are in fluid flow communication with each other. As discussed in detail below, the start-up mode of operation is characterized by the isolation of flow loops 26, 28, 30 from fluid flow communication with each other. In one embodiment, fluid flow communication between flow loops 26, 28, 30 is controlled with a first isolation system 62 and a second isolation system 64. First isolation system 62 generally includes a first conduit 66, a first isolation valve 68, and a first bypass valve 70. Similarly, second isolation system 64 generally includes a second conduit 72, a second isolation valve 74, and a second bypass valve 76. To allow fluid flow communication between flow loops 26, 28, 30, isolation valves 68, 74 and/or bypass valves 70, 76 are open to thereby allow compressed gas to flow between the low, intermediate, and high compression stages 20, 22, 94. When fluid flow communication is allowed between the compression stages 20, 22, 24 of multi-stage compressor 14, flow loops 26, 28, 30 are said to be "de-isolated." When flow loops 26, 28, 30 are de-isolated (i.e., during normal mode of operation), compressed gas flows from the outlet of low compression stage 20 into the suction of intermediate compression stage 22 and from the discharge of intermediate compression stage 22 to the suction of high compression stage 24. To isolate flow loops 26, 28, 30 by preventing fluid flow communication between low, intermediate, and high compression stages 20, 22, 24, isolation valves 68, 74 and bypass valves 70, 76 are closed. The methodology of starting up compressor/driver system 10 will be discussed in further detail in a subsequent section.

According to the embodiment illustrated in FIG. 1, compressor flow control system 16 can additionally comprise a start-up gas system 78, which is operable to control the flow of start-up gas to and from compression stages 20, 22, 24 and flow loops 26, 28, 30. Start-up gas system 78 generally includes a start-up gas source 80 in fluid communication with low-, intermediate-, and high-stage flow loops 26, 28, 30 by respective start-up gas injection conduits 82, 84, 86. Each start-up gas conduit includes a respective start-up gas injection valve 90, 92, 94 to control the flow of the start-up gas from start-up gas source 80 to flow loops 26, 28, 30. In addition, each flow loop 26, 28, 30 can additionally include a respective purge valve 96, 98, 100 to vent gas from the system as needed. During normal operation mode, start-up gas injection valves 90, 92, 94 and purge valves 96, 98, 100 are typically closed. As detailed in a subsequent section, these valves can either be open or closed during start-up to establish positive pressure in flow loops 26, 28, 30 and compression stages 20, 22, 24.

As illustrated in FIG. 1, compressor flow control system 16 also includes a working fluid inlet conduit 102 having disposed therein an inlet control valve 104 and a working fluid outlet conduit 106 in fluid communication with an outlet control valve 108. During normal operation, control valves 102, 108 are generally open to allow flow of the working fluid into and out of multi-stage compressor 14 and its associated flow loops 26, 28, 30. As discussed below in further detail, control valves 104, 108 can be closed during start-up mode of operation in order to isolate low compression stage 20 and high compression stage 24 from the inlet and outlet 102, 106 working fluid conduits and other respective upstream and downstream processing equipment.

In another embodiment, compressor flow control system 16 can also include one or more intermediate-stage and/or high-stage feed streams (not shown). If present, these additional feed streams combines with the discharged gas from the upstream compression stage prior to entering the compression stage with which it is associated.

The start-up mode of operation of the compressor/driver system 10 illustrated in FIG. 1 will now be described in detail with reference to the flow chart provided in FIG. 2 and the valve position summary represented in Table 1 below.

TABLE 1

Valve Position Summary During Start-Up Mode

| Valve | | Block (FIG. 2) | | | | | | | |
|---|---|---|---|---|---|---|---|---|---|
| (FIG. 1) | Function | 200 | 204 | 206 | 208 | 212 | 214 | 216 | 218 |
| 19 | Fuel to Gas Turbine | C | C | C | O | O | O | O | O |
| 38 | Low-stage Anti-Surge | O | O | O | O | O | O | O | OAC |
| 48 | Intermediate-stage Anti-Surge | O | O | O | O | O | O | O | OAC |
| 58 | High-stage Anti-Surge | O | O | O | O | O | O | O | OAC |
| 68 | First Isolation | C | C | C | C | C | C | O | O |
| 70 | First Bypass | C | C | C | C | C | C | O | C |
| 74 | Second Isolation | C | C | C | C | C | C | O | O |
| 76 | Second Bypass | C | C | C | C | C | C | O | C |
| 90 | Low-stage Start-up Gas | C | C | O | C | O | C | C | C |
| 92 | Intermediate-stage Start-up Gas | C | C | O | C | O | C | C | C |
| 94 | High-stage Start-up Gas | C | C | O | C | O | C | C | C |
| 96 | Low-stage Purge | C | O | C | C | C | C | C | C |
| 98 | Intermediate-stage Purge | C | O | C | C | C | C | C | C |
| 100 | High-stage Purge | C | O | C | C | C | C | C | C |
| 104 | Working Fluid Inlet | C | C | C | C | C | C | C | O |
| 108 | Working Fluid Outlet | C | C | C | C | C | C | C | O |

Valve Positions:
Open (O),
Closed (C), or
Open, Automatic Control (OAC)

Figure 2:
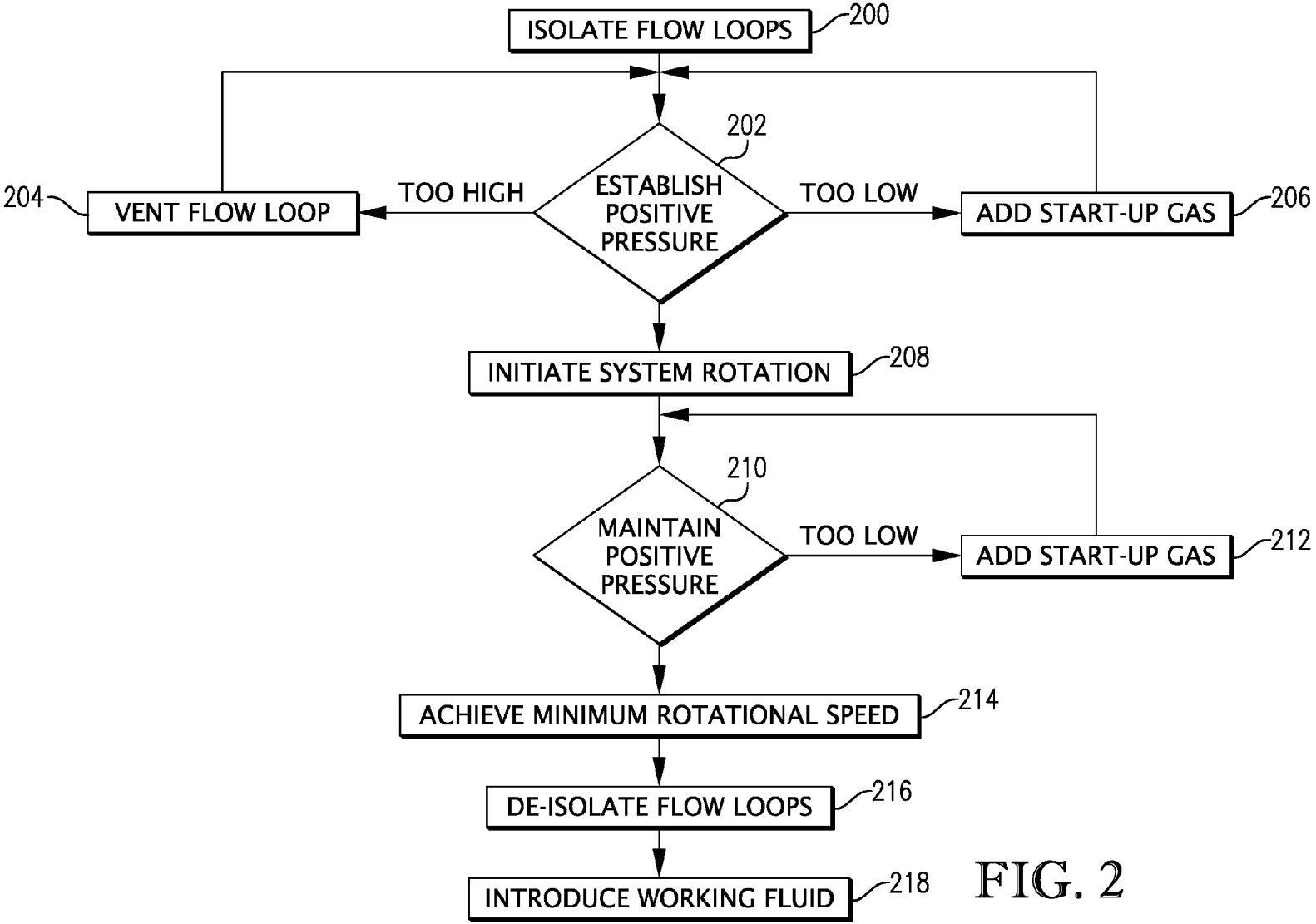
FIG. 2 is a flowchart of steps involved in the start-up of the compressor/driver system illustrated in FIG. 1.

In particular, FIG. 2 outlines the major steps involved in starting up the compressor/driver system 10 and Table 1 summarizes the positions of each valve shown in FIG. 1 as described above during the start-up and normal modes of operation.

As previously discussed, the start-up mode of compressor/driver system 10 in FIG. 1 is characterized by the isolation of flow loops 26, 28, 30 from fluid flow communication with each other as regulated by first and second isolation systems 62, 64. Thus, the first step to start-up compressor/driver system 10 is to isolate each flow loop, as depicted by block 200 in FIG. 2. As shown in Table 1, this requires that first and second isolation valves 68, 74; first and second bypass valves 70, 76; working fluid inlet valve 104; and working fluid outlet valve 108 be closed to thereby prevent fluid flow between flow loops 26, 28, 30, compression stages 20, 22, 24, and the working fluid entering and discharged from multi-stage compressor 14 via conduits 102 and 108, respectively, as illustrated in FIG. 1. In addition, during this step, purge valves 96, 98, 100 and start-up gas valves 90, 92, 94 are also closed. Anti-surge valves 38, 48, 58 are opened in order to create a pathway for compressed gas to ultimately flow in a closed isolated flow loop during a subsequent stage of the start-up mode, as described in more detail shortly. At this point, gas turbine 12 may not be rotating, and fuel valve 19 may be closed. As used herein, the term "closed" refers to a valve that is greater than 75 percent, greater than 85 percent, greater than 95 percent, or greater than 99 percent closed.

Once flow loops 26, 28, 30 have been isolated, a positive pressure can be established in each flow loop as represented in block 202 of FIG. 2. In one embodiment, the positive pressure of flow loops 26, 28, 30 can be in the range of from about 0.5 to about 50 pounds-per-square-inch, gauge (psig), about 0.75 to about 25 psig, or 1 to about 20 psig. To adjust the positive pressure in one or more flow loops, gas may be added or removed from the isolated loops as needed. If the pressure in a flow loop is too high, excess gas may be purged from the system by a purge valve. For example, if the positive pressure in intermediate compression stage 22 is too high, excess vapor can be vented, as shown by block 204 in FIG. 2, to a hydrocarbon flare system or routed to the low-stage suction of another compressor by opening purge valve 98, as illustrated in Table 1. Similarly, opening purge valves 96, 100, as shown in Table 1, can reduce the positive pressure in the low and high compression stages 20 and 24, respectively.

If the positive pressure in a flow loop is too low, additional gas may be introduced into the system, as shown in block 206 in FIG. 2, by start-up gas system 78 illustrated in FIG. 1. Start-up gas source 80 may be any internal or external source capable of delivering gas into flow loops 26, 28, 30 while maintaining their respective positive pressures. In one embodiment, start-tip gas can be a hydrocarbon-containing gas. Generally, start-up gas is introduced into low, intermediate, and/or high compression stage 20, 22, 24 as needed by opening respective start-up gas injection valves 90, 92, 94, as shown in Table 1. In one embodiment, start-up gas may be used as a purge gas to remove existing material from one or more flow loops prior to establishing positive pressure.

Because flow loops 26, 28, 30 remain isolated (as shown in Table 1) during the steps depicted in blocks 200, 204, and 206 in FIG. 2, it is possible to alter the positive pressure in one or more individual flow loops without affecting the pressure in other flow loops. In one embodiment, the positive pressure in one or more flow loops may be within about 50 percent, about 75 percent, about 90 percent, or 95 percent of the positive pressure in another flow loop. In another embodiment, the positive pressures in each flow loop are substantially equal.

The next step in the start-up mode of compressor/driver system 10 is to initiate compressor/driver system rotation as outlined in block 208 in FIG. 2. In one embodiment, compressor/driver system 10 illustrated in FIG. 1 additionally comprises an optional auxiliary motor 21 coupled to the output drive shaft 18 on the outboard end of low compression stage 20 to provide supplemental power to rotate gas turbine 12 during this phase of the start-up method. In accordance with one embodiment of the present invention, the optional auxiliary motor provides less than about 50 percent, less than about 30 percent, less than about 20 percent, less than about 10 percent, or less than 5 percent of the total power required to initiate rotation of compressor/driver system 10.

In another embodiment, the rotation of compressor/driver system 10 is initiated solely under the power of gas turbine 12 and its built-in starting device (not shown). As illustrated in Table 1, fuel valve 19 can be opened during this step and gas turbine 12 may be started.

Once rotation has been initiated, the system can be checked to ensure a minimum positive pressure has been maintained, as illustrated in block 210 in FIG. 2. If the positive pressure is too low, additional start-up gas may be introduced into the system, as represented by block 212, by means of start-up gas system 78 illustrated in FIG. 1, as previously described. As shown in Table 1, start-up gas may be introduced into low, intermediate, and/or high compression stage 20, 22, 24 by opening start-up gas injection valves 90, 92, 94 respectively.

Once an adequate positive pressure has been reestablished, the compressor/driver system 10 can then be allowed to achieve minimum rotational speed, as shown in block 214 of FIG. 2. As illustrated by the valve positions in shown in Table 1, the flow loop 26, 28, 30 remain isolated and, as the rotational speed of compressor/driver system 10 is increased to a minimum rotational speed, compressed gas discharged from each compression stage can be circulated back to its suction via its recycle conduit and anti-surge valve, as described previously. The minimum rotational speed of the compressor/driver system 10 depends on several factors, including the turbine size, compressor size and configuration, and the like. In one embodiment, the minimum rotational speed is at least about 500 revolutions per minute (rpm), at least about 1,500 rpm, or at least 3,000 rpm. In one embodiment, each flow loop maintains a desired minimum positive pressure. In accordance with one embodiment, maintaining positive pressure during the rotation of compressor/driver system 10 prevents the pressure in each flow loop from dropping below atmospheric pressure (i.e., a vacuum).

After compressor/driver system 10 achieves the minimum rotational speed, the flow loops can be de-isolated, as depicted by block 216 in FIG. 2. As discussed previously, when the flow loops are de-isolated, gas flow is permitted between two or more the stages of multi-stage compressor 14. As shown in Table 1, flow loops 26, 28, 30 can be de-isolated by opening isolation valves 68, 74 while the compressor/driver system 10 continues to rotate at or above its minimum speed.

In one embodiment immediately prior to opening isolation valves 68, 74, bypass valves 70, 76 can be opened to reduce the pressure differential across the isolation valves and equalize the positive pressure between two adjacent loops. For example, according to the embodiment illustrated in FIG. 1, opening bypass valve 70 immediately prior to opening isolation valve 68 can equalize the pressure between isolated low compression stage 20 and intermediate compression stage 22. Similarly, reducing the pressure differential between intermediate compression stage 22 and high compression stage 24 can include opening bypass valve 76 prior to opening isolation valve 74. In one embodiment, bypass valves can have smaller port sizes than their corresponding isolation valves. In another embodiment, a bypass valve can be positioned parallel to its corresponding isolation valve. Positions of each valve shown in FIG. 1 during the step of flow loop de-isolation are shown in Table 1.

At this point, the working fluid can now be introduced into the compressor, as depicted in block 218 of FIG. 2. As shown in Table 1, working fluid inlet control valve 104 and working fluid outlet control valve 108 can be opened to introduce the working fluid into low compression stage 20 and thereby transition the compressor/driver system 10 into its normal mode of operation. In one embodiment, anti-surge valves 38, 48, 58 may be placed on automatic control during the normal mode of operation.

In one embodiment of the present invention, the compressor system described and illustrated herein can be employed to compress one or more refrigerant streams. For example, the turbine-driven compressor systems described herein can be used to compress hydrocarbon-containing refrigerants employed as part of a mechanical refrigeration cycle used to cool natural gas in a liquefied natural gas (LNG) plant. In one embodiment, the compressor system can be utilized in a mixed-refrigerant LNG process, such as the process described by U.S. Pat. No. 4,445,917, which is incorporated herein by reference. In another embodiment, the inventive compressor system can be employed in a cascade-type LNG refrigeration process, such as the one disclosed in U.S. Pat. No. 6,925,387, which is incorporated herein by reference.

Numeric Ranges

The present description uses numeric ranges to quantify certain parameters relating to the invention. It should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

DEFINITIONS

As used herein, the terms "a," "an," "the," and "said" means one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the term "anti-surge valve" refers to a valve used to regulate flow from the discharge of a compression stage to the suction of the same compression stage.

As used herein, the term "auxiliary motor" refers to an electric motor or other driver coupled to the outboard end of a gas turbine used to provide additional power to help rotate the gas turbine during the start-up mode.

As used herein, the term "cascade refrigeration process" refers to a refrigeration process that employs a plurality of refrigeration cycles, each employing a different pure component refrigerant to successively cool natural gas.

As used herein, the term "compression stage" refers to one element of a compressor wherein the pressure of an incoming gas in increased.

As used herein, the terms "containing," "contains," and "contain" have the same open-ended meaning as "comprising," "comprises," and "comprise."

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the term "de-isolate" refers to the act of establishing fluid flow communication between two or more previously-isolated flow loops. As used herein, the term "flow loop" refers to the flow path between a compressor stage's discharge and suction, piece As used herein, the terms "having," "has," and "have" have the same open-ended meaning as "comprising," "comprises," and "comprise."

As used herein, the term "hydrocarbon-containing" refers to material that contains at least 5 mole percent of one or more hydrocarbon compounds.

As used herein, the terms "including," "includes," and "include" have the same open-ended meaning as "comprising," "comprises," and "comprise."

As used herein, the term "intercooler" refers to any device used to cool fluid between compression stages.

As used herein, the term "multi-stage compressor" refers to a compressor that utilizes two or more compression stages to successively increase the pressure of an incoming gas.

As used herein, the term "mixed refrigerant" means a refrigerant containing a plurality of different components, where no single component makes up more than 75 mole percent of the refrigerant.

As used herein, the term "positive pressure" refers to a pressure above atmospheric pressure.

As used herein, the term "pure component refrigerant" means a refrigerant that is not a mixed refrigerant.

As used herein, the term "start-up gas" refers to a stream of internal or external gas supplied to the system in during the start-up mode to purge existing material and/or establish adequate positive pressure in one or more flow loops.

As used herein, the term "working fluid" refers to the gas being compressed during normal operation of a compressor.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of operating a multi-stage compressor, wherein said multi-stage compressor utilizes multiple compression stages, said method comprising:

(a) simultaneously isolating each compression stage of said multi-stage compressor from fluid flow communication with one another;

(b) establishing positive pressure in each compression stage, wherein said positive pressure in each compression stage is in the range of from about 0.5 to about 50 psig; and (c) initiating rotation of said multi-stage compressor.

2. The method of claim 1, wherein the positive pressure established in one compression stages is within about 90 percent of the positive pressure established in another compression stages.

3. The method of claim 1, wherein said positive pressure is established by introducing a start-up gas into one or more compression stages.

4. The method of claim 3, wherein said start-up gas is a hydrocarbon-containing gas.

5. The method of claim 3, further comprising using said start-up gas to purge an existing material from said at least two compression stages.

6. The method of claim 1, further comprises an auxiliary motor for initiating rotation of step (c), wherein said auxiliary motor provides less than about 20 percent of the required power to initiate rotation of said multi-stage compressor.

7. The method of claim 1, wherein said multi-stage compressor is operably coupled to a gas turbine.

8. The method of claim 7, wherein said gas turbine is a single-shaft gas turbine.

9. The method of claim 8, wherein said initiating rotation of step (c) is accomplished solely under the power of said gas turbine and a built-in starting device that is built into the gas turbine.

10. The method of claim 1, further comprising increasing the rotational speed of said multi-stage compressor to a minimum operating speed while maintaining fluid isolation of said at least two compression stages from one another.

11. The method of claim 10, wherein said minimum operating speed is at least about 500 rpm.

12. The method of claim 10, further comprising maintaining positive pressure on each of at least two compression stages during said increasing of the rotational speed of said multi-stage compressor.

13. The method of claim 10, further comprising de-isolating said at least two compression stages while said multi-stage compressor is rotating at said minimum speed to thereby permit fluid communication between said at least two compression stages.

14. The method of claim 13, wherein said isolating and de-isolating are caused by closing and opening an isolation valve fluidly disposed between at least two compression stages.

15. The method of claim 14, further comprising, prior to opening said isolation valve, permitting fluid to flow through a bypass valve around said isolation valve to thereby reduce the pressure differential across said isolation valve.

16. The method of claim 13, wherein during said increasing of the rotational speed of said multi-stage compressor each of said at least two compression stages forms an isolated closed loop system of circulating fluid.

17. The method of claim 16, wherein each of said isolated closed loop systems comprises an anti-surge valve that is at least partially open during said increasing of the rotational speed of said multi-stage compressor.

18. The method of claim 16, wherein each of said isolated closed loop systems comprises an intercooler.

19. The method of claim 16, wherein said de-isolating includes opening an isolation valve fluidly disposed between said closed loop systems.

20. The method of claim 13, further comprising after said de-isolating, using said multi-stage compressor to compress a hydrocarbon-containing refrigerant.

21. The method of claim 1, wherein said multi-stage compressor is employed to compress a refrigerant in a refrigeration cycle of a liquefied natural gas facility.

22. The method of claim 1, wherein step (a) includes isolating at least three compression stages of said multi-stage compressor.

* * * * *